United States Patent [19]

Haneda et al.

[11] Patent Number: 5,063,411

[45] Date of Patent: Nov. 5, 1991

[54] COLOR IMAGE FORMING APPARATUS HAVING A UNITARY GUIDE PLATE FACING A PLURALITY OF DEVELOPING DEVICES

[75] Inventors: Satoshi Haneda; Masakazu Fukuchi; Shunji Matsuo; Shizuo Morita, all of Hachioji, Japan

[73] Assignee: Konica Corporation, Tokyo, Japan

[21] Appl. No.: 535,121

[22] Filed: Jun. 8, 1990

[30] Foreign Application Priority Data

| | | | |
|---|---|---|---|
| Jun. 16, 1989 | [JP] | Japan | 1-153743 |
| Jul. 7, 1989 | [JP] | Japan | 1-177729 |
| Jul. 25, 1989 | [JP] | Japan | 1-192874 |

[51] Int. Cl.[5] ..... G03G 5/00; G03G 15/01

[52] U.S. Cl. ..... 355/212; 355/245; 355/296; 355/327

[58] Field of Search ..... 355/326, 327, 245, 212, 355/211, 210, 296; 346/157; 118/645

[56] References Cited

U.S. PATENT DOCUMENTS

| | | | |
|---|---|---|---|
| 3,880,518 | 4/1975 | Chatfield | 355/212 |
| 4,271,786 | 6/1981 | Buckley et al. | 355/245 X |
| 4,285,590 | 8/1981 | Silverberg . | |
| 4,470,690 | 9/1984 | Hoffman | 355/212 |
| 4,630,919 | 12/1986 | Fantuzzo et al. | 355/212 X |
| 4,657,369 | 4/1987 | Takeuchi | 355/212 |
| 4,797,703 | 1/1989 | Guslits | 355/212 |
| 4,806,967 | 2/1989 | Newbury | 355/210 |
| 4,821,066 | 4/1989 | Foote, Jr. et al. | 355/212 X |
| 4,841,333 | 6/1989 | Damji | 355/211 |

FOREIGN PATENT DOCUMENTS

| | | |
|---|---|---|
| 0044919 | 2/1982 | European Pat. Off. . |
| 57-34576 | 2/1982 | Japan . |
| 60-75850 | 4/1985 | Japan . |
| 60-76766 | 5/1985 | Japan . |
| 60-95456 | 5/1985 | Japan . |
| 60-95458 | 5/1985 | Japan . |
| 60-102677 | 6/1985 | Japan . |
| 63133743 | 7/1985 | Japan . |
| 60-158475 | 8/1985 | Japan . |
| 61-100770 | 5/1986 | Japan . |
| 61-149972 | 8/1986 | Japan . |

OTHER PUBLICATIONS

Research Disclosure, No. 192, Apr. 1980, pp. 152, K. J. Powers, "Positioning an Electrophotographic Toning Station", entire disclosure.

Curran et al., "Tensioning System for Photoconductor Belt", Mar. 1982, IBM Technical Disclosure Bulletin, vol. 24, No. 10, pp. 5019-5020.

*Primary Examiner*—Joan H. Pendegrass

*Assistant Examiner*—Shuk Y. Lee

*Attorney, Agent, or Firm*—Frishauf, Holtz, Goodman & Woodward

[57] ABSTRACT

The invention provides a color image forming apparatus with photoreceptor belt. In a roll of the photoreceptor belt provided two pieces of rotatable rollers and guide plate with a curved surface so that the photoreceptor belt is moved while slidably coming in contact with the curved surface of the guide plate. Along the outer surface of the roll of the photoreceptor belt provided a plurality of developing devices at the curved surface to form a color toner image on the photoreceptor belt.

15 Claims, 7 Drawing Sheets

COLOR IMAGE FORMING APPARATUS HAVING A UNITARY GUIDE PLATE FACING A PLURALITY OF DEVELOPING DEVICES

BACKGROUND OF THE INVENTION

This invention relates to a color image forming apparatus in which a toner image is formed on a belt-like photoreceptor by the method of electrophotography and the image is transferred onto a transfer paper in order to obtain a color image.

Many electrophotographic methods and apparatuses to obtain a color image have been proposed. For example, the following method to obtain a color copy is disclosed in Japanese Patent Publication Open to Public Inspection No. 100770/1986: a latent image is formed and developed on a photoreceptor drum, wherein the number of the latent image forming operations corresponds to the number of separate colors; each time the latent image is developed it is transferred onto a transfer drum to form a multicolor image; and the multicolor image is transferred from the transfer drum onto a recording paper. In this method, it is necessary to provide a transfer drum the circumferential surface of which is wide enough for an image on the photoreceptor to be transferred. Accordingly, this apparatus is large and complicated.

The following method is disclosed in Japanese Patent Publication Open to Public Inspection No. 149972/1986: a latent image is formed and developed on a photoreceptor drum, wherein the number of image forming operations corresponds to the number of separate colors of a document image; and each time the latent image is developed the image is transferred onto a transfer paper to obtain a multicolor image. In this method, it is difficult for multicolor images to be precisely superimposed Consequently, a color copy of high quality can not be obtained.

Another prior art method is characterized in that: latent image forming and latent image developing by color toner are repeatedly conducted on a photoreceptor so that the color toner images can be superimposed; and the color toner image is transferred onto a transfer paper in order to obtain a color image. The basic process of the above-described multicolor image forming method is disclosed in Japanese Patent Publication Open to Public Inspection No. 75850/1985, No. 76766/1985, No. 95456/1985, No. 95458/1985, and No. 158475/1985, which were applications by the present inventors.

In this kind of multicolor image forming apparatus in which a color image can be obtained by superimposition, a plurality of developing units containing different color toners are provided around the circumferential surface of a photoreceptor drum and the photoreceptor drum is rotated a plurality of times so that the latent image on the photoreceptor can be developed.

It has been proposed that the image forming body include: a flexible belt image forming body on which the photoconductive material is coated or provided as well as a photoreceptor drum on which the photoconductive material is coated or vapor-deposited. The flexible belt image forming body, which will be called the photoreceptor belt hereafter, is stretched between a drive roller and an idle roller. Accordingly, when the photoreceptor belt is used in a color image forming apparatus, the space is effectively utilized. As a result, the apparatus can be made compact. Even when the drive roller or the idle roller has a small diameter, the photoreceptor belt can run smoothly. Consequently, when a small diameter roller is used in the belt portion of the apparatus, transfer papers can be properly separated from the belt at the small diameter roller portion so that defective paper separation can be prevented.

In a color image forming apparatus in which the photoreceptor belt is used, the image forming means such as the charging means, the image exposing means, and the developing means comprising a plurality of developing units, are provided around the photoreceptor belt. The above-described image forming means face the photoreceptor belt, wherein there is a constant gap between them.

In order to keep a constant gap between the photoreceptor belt and the image forming means, a back-up roller can be used as a support so that the photoreceptor belt can be supported when it faces the image forming means. However, when the back-up roller is used in the apparatus, it is necessary to provide many back-up rollers corresponding to the number of image forming means. When many back-up rollers are provided in the apparatus, it is difficult to keep them in parallel with the drive roller or the idle roller between which the photoreceptor belt is stretched. As disclosed in Japanese Patent Publication Open to Public Inspection No. 34576/1982, an apparatus is proposed in which the photoreceptor belt is supported by a guide member so that the belt can face the image forming means. However, it is difficult to maintain the gap between the photoreceptor belt and the image forming means. In the apparatus which is disclosed in Japanese Patent Publication Open to Public Inspection No. 102677/1985, the guide member comes into contact with the photoreceptor belt in a large area. However, when the contact area between the belt and the guide is large, the load is increased and slippage occurs between the drive roller and the photoreceptor belt.

SUMMARY OF THE INVENTION

The object of the present invention is to provide a color image forming apparatus which is characterized in that: the photoreceptor belt can be driven without a heavy load; the image forming means faces the photoreceptor belt, wherein the gap between the image forming means and the belt can be precisely maintained; and a photoreceptor belt is provided by which a color image of high quality can be obtained.

The above-described object can be attained by a color image forming apparatus which is characterized in that: two rollers, a photoreceptor belt , and a curved guide member are provided, wherein the photoreceptor belt is stretched between the rollers, and the curved guide member is installed between the rollers; the photoreceptor belt is slidably conveyed over the guide; image forming means including a plurality of developing units are provided around the photoreceptor belt; the photoreceptor belt is slidably conveyed over the guide member where the belt is faced by the image forming means; and the photoreceptor belt is separated from the guide in the region where the belt is not faced by the image forming means, wherein the guide member is provided with a cut-out portion so that the belt can be separated from the guide member in the above-described region.

A further object of the present invention is to provide a color image forming apparatus comprising a photoreceptor belt which can face the image forming means maintaining a precise gap between the belt and the image forming means so that an image of high quality can be obtained on the photoreceptor belt. The above-described object can be accomplished by a color image forming apparatus which is characterized in that: the apparatus is provided with two rollers, a guide member installed between the rollers, and a photoreceptor belt stretched between the rollers, wherein the belt is slidably conveyed over the above-described guide member; an image forming means including a plurality of developing means is provided around the photoreceptor belt; and the above-described image forming means is faced by the photoreceptor belt, the rear side of which is supported by small protrusions of small radius of curvature on the guide member to meet the position of the image forming means.

The above-described object of the present invention can be accomplished by a color image forming apparatus which is characterized in that: the apparatus is provided with two rollers, a curved guide member placed between the two rollers, and a photoreceptor belt stretched between the two rollers and slidably conveyed over the above-described guide; an image forming means including a plurality of developing means is provided around the photoreceptor belt; and a plurality of developing means described above are placed in parallel to face the photoreceptor belt, the rear surface of which is supported by the guide members.

DETAILED DESCRIPTION

Figure 1:
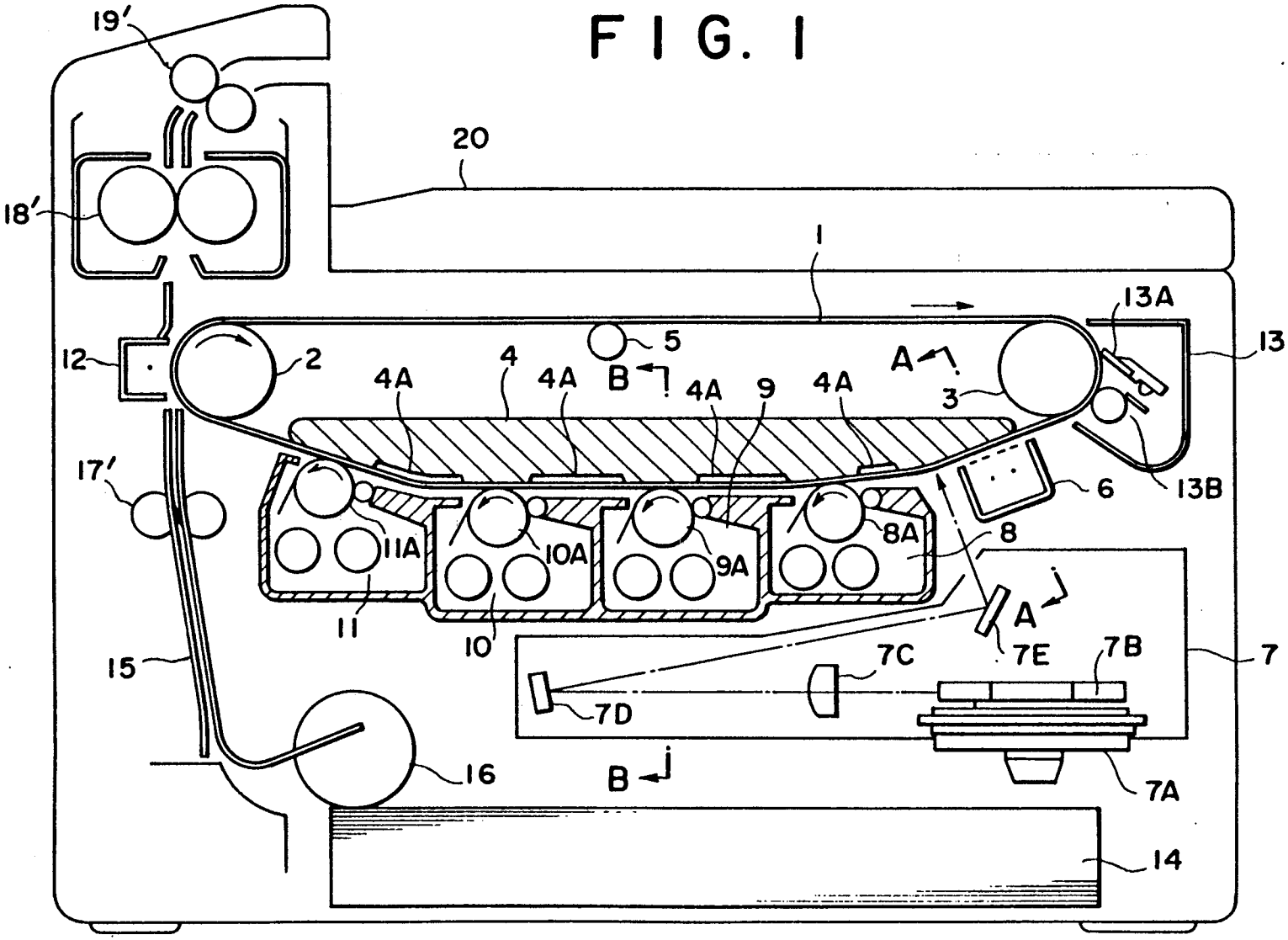
FIG. 1 is a sectional view of the color image forming apparatus of the present invention.
Figure 2:
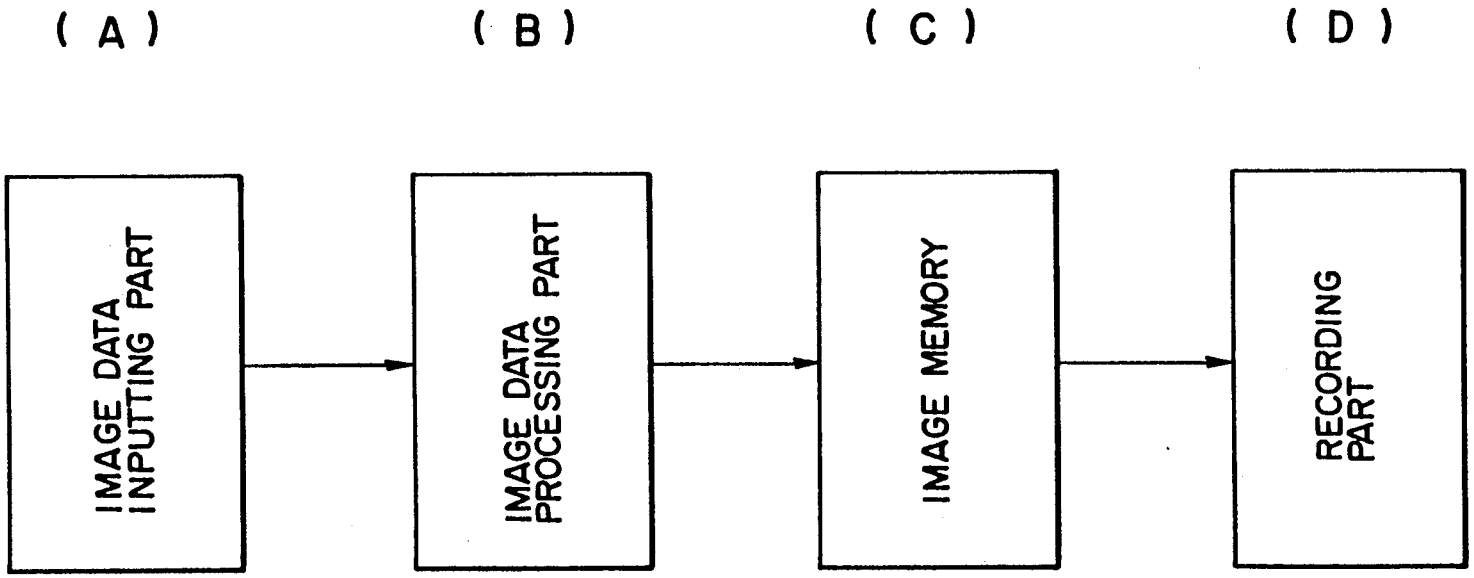
FIG. 2 is a block diagram which shows the image forming system of the apparatus of the present invention.
Figure 3A:
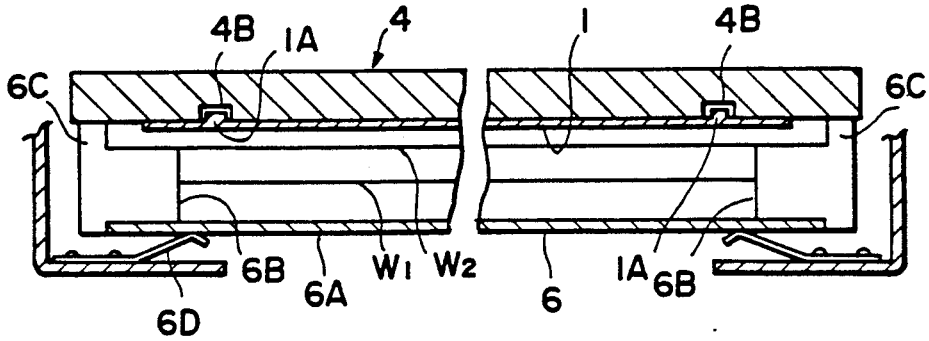
FIGS. 3-A, 3-B, and 3-C are sectional views of the main portions of the apparatus of the present invention.
Figure 3B:
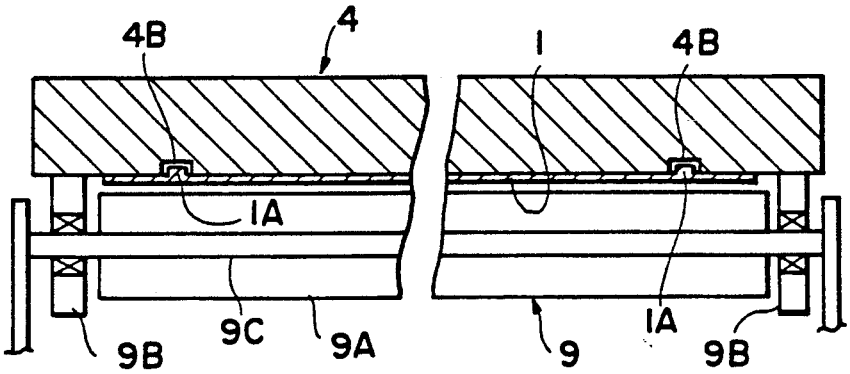
Figure 3C:
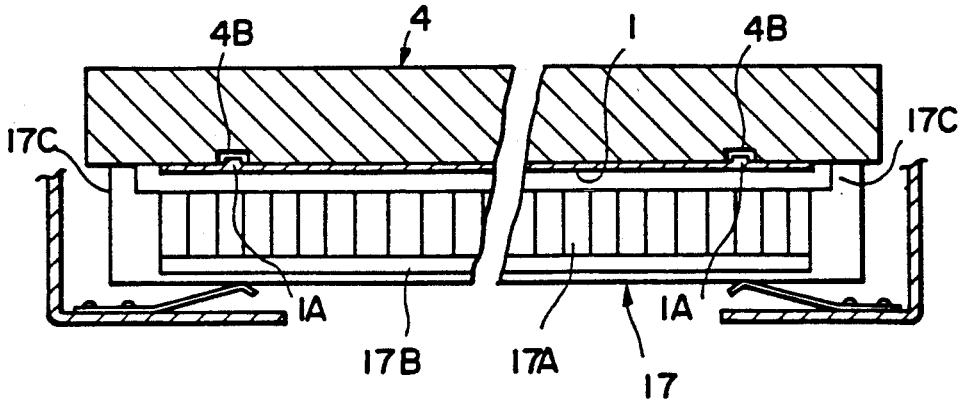

An example of the color image forming apparatus of the present invention is illustrated in FIGS. 1, 2, 3-A, 3-B, 3-C, and 4.

The numeral 1 is a flexible photoreceptor belt. The photoreceptor belt 1 is stretched between the roller 2 and the roller 3. The photoreceptor belt 1 is driven clockwise by the roller 2.

The numeral 4 is a guide member which is provided to the apparatus body and touches the photoreceptor belt 1 internally. The photoreceptor belt 1 is stretched by the tension roller 5 so that its internal surface comes into contact with the guide member 4.

Accordingly, the positional relation between the external surface of the photoreceptor belt 1 and the surface of the guide 4 can always be kept constant so that an image forming surface is stably formed on the surface of the photoreceptor belt 1.

The numeral 6 is a Scorotron charger. The numeral 7 is a laser writing unit which is an exposure means. The numerals 8, 9, 10, and 11 are a plurality of developing units which contain the developing agents of specific colors. These image forming means are provided at the portion where the photoreceptor belt 1 comes into contact with the guide member 4.

Not only the optical unit shown in the drawing but also the optical unit to which the light emitting unit and the fibre lens array are integrally provided, are used instead of the laser writing unit 7.

The developing units 8, 9, 10, and 11 contain the developing agents of yellow, magenta, cyan, and black, for instance. The developing units have the developing sleeves 8A, 9A, 10A, and 11A which are located to maintain a prescribed gap between the sleeves and the photoreceptor belt 1. The developing by the method of non-contact development changes a latent image on the photoreceptor belt into a visual image. The method of non-contact development has the advantage of not interfering with the motion of the photoreceptor belt as compared with the method of contact development.

The numeral 12 is a transfer unit. The numeral 13 is a cleaning unit. The blade 13A and the toner conveyance roller 13B of the cleaning unit 13 are kept apart from the surface of the photoreceptor belt 1 when an image is formed and they come into contact with the surface of the photoreceptor belt 1 only when cleaning is conducted.

The process of color image forming by the color image forming apparatus explained above is as follows.

In this example, multicolor image forming is carried out according to the image forming system shown in FIG. 2. The data obtained by the image data inputting part (A) in which the original image is focused on an image pickup element by scanning, is processed by the image data processing part (B) to make the image data. The image data is once stored in the image memory (C). Then, the image data is taken out from the image memory (C) and inputted into the recording part (D), for example into the color image forming apparatus illustrated in FIG. 1.

To be more concrete, an image is formed as follows. A color image signal is outputted from another image reading apparatus than the image forming apparatus illustrated in FIG. 1, and inputted into the above-described laser writing unit 7. In the laser writing unit 7, the laser beam generated by the laser diode (not illustrated in the drawing) falls on the polygonal mirror 7B rotated by the driving motor 7A and its optical path is folded by the mirrors 7D and 7E after being passed through $f\theta$ lens 7C. The laser beam falls on the surface of the photoreceptor belt on which electrical potential has been previously impressed by the charger 6. Consequently, a written line is formed on the surface of the photoreceptor belt.

On the other hand, when optical scanning is started, the beam is detected by an index sensor and beam modulation is started for the first color signal. The modulated beam scans the surface of the photoreceptor belt 1. Accordingly, the latent image corresponding to the first color is formed on the surface of the photoreceptor belt 1 by the primary scanning and the sub scanning, wherein the primary scanning is conducted by the laser beam itself and the sub scanning is conducted by the movement of the photoreceptor belt 1. This latent image is developed by the developing unit 8 which is loaded with the yellow (Y) toner so as to form a toner image on the belt surface. The obtained toner image on the photoreceptor belt passes under the cleaning unit 13 which is apart from the surface of the photoreceptor 1 and the apparatus gets into the next copy process.

The photoreceptor belt 1 is charged by the charger 6 again. Then, the second color signal outputted from the signal processing unit is inputted into the laser writing unit 7 and the second color image is written onto the belt surface so as to form a latent image in the same way as in the case of the first color signal. This latent image is developed by the developing unit 9 which is loaded with the toner of the second color of magenta (M). The toner image of magenta (M) is formed on the above-described toner image of yellow (Y) and remains on the belt surface and is superimposed on the yellow image.

The numeral 10 is a developing unit which is loaded with the toner of cyan (C) This developing unit 10 develops the toner image of cyan (C) on the belt surface according to the control signal generated by the signal processing unit.

Furthermore, the numeral 11 is a developing unit which is loaded with the toner of black. This developing unit forms a black toner image on the belt surface, wherein the black toner image is superimposed on the images the other colors. D.C. and/or A.C. biased D.C. are impressed on the sleeves of the developing units 8, 9, 10 and 11 so that the toner jumping development can be conducted in the two components development, wherein the toner image on the photoreceptor belt 1 which is grounded is developed without coming into contact with the developer on the sleeve surface. In this case, the one component developing agent may be used to conduct the non-contact development. The toner image which has been formed on the surface of the photoreceptor belt in the above-described way, is transferred onto a transfer paper at the transfer station, wherein the transfer paper was sent from the paper feeding cassette 14 through the paper feeding guide 15.

To be more concrete, the uppermost transfer paper of the transfer papers stacked on the paper feeding cassette 14 is conveyed by the paper feeding roller 16. The transfer paper is conveyed through the timing roller 17' to the transfer unit 12 synchronously with the movement of the image formed on the photoreceptor belt 1.

Figure 6:
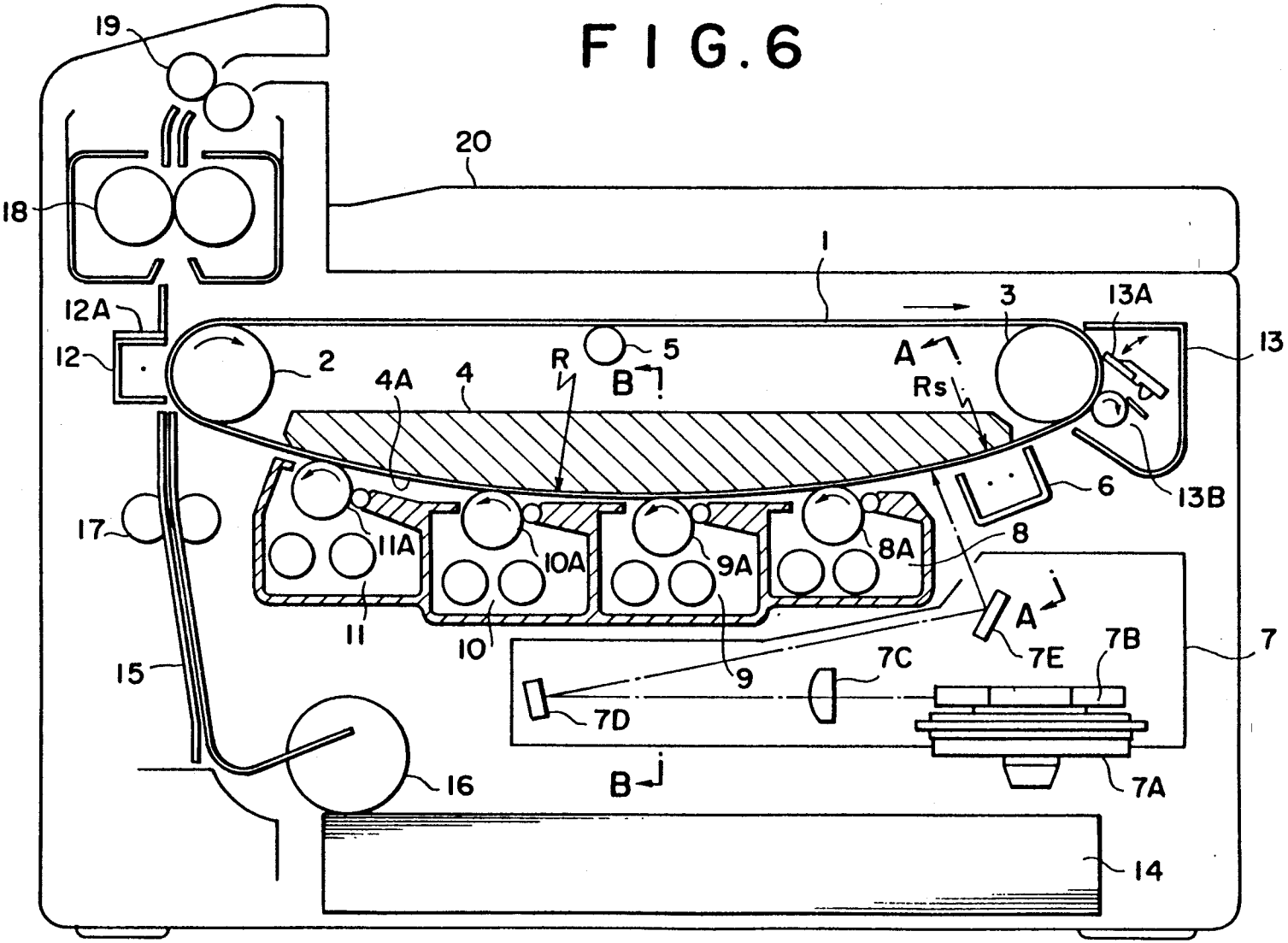
FIG. 6 and FIG. 7 are sectional views of the color image forming apparatus of another example of the present invention.
Figure 7:
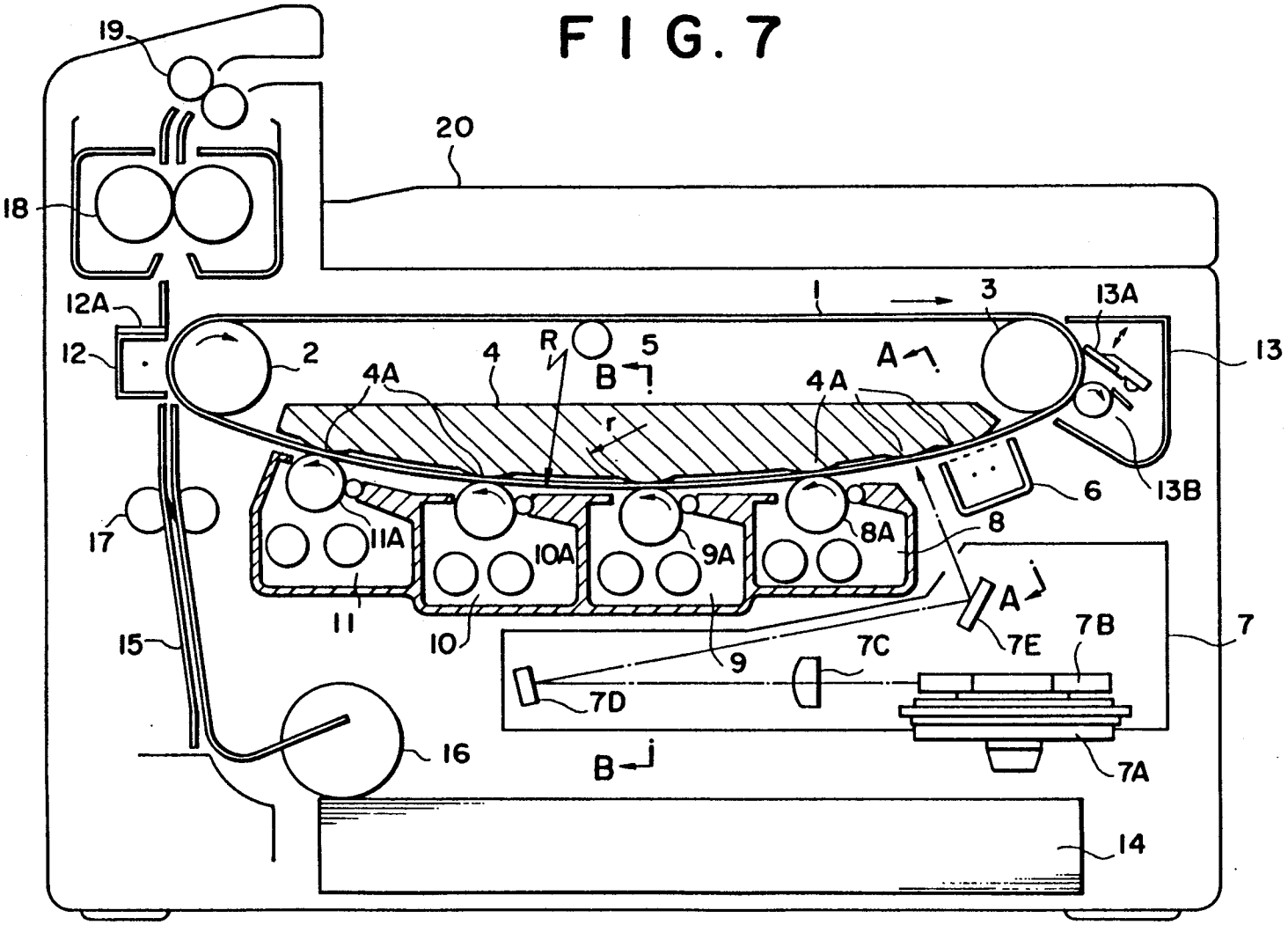
Figure 8A:
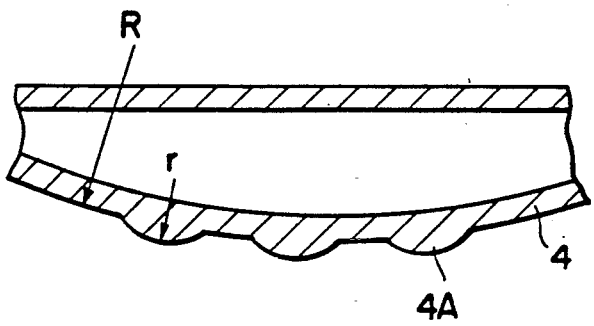
FIGS. 8-*a*, 8-*b*, 8-*c*, 8-*d*, and 8-*e* are sectional views of the curved protruded portions provided to the guide members of the image forming apparatus illustrated in FIG. 7.
Figure 8B:
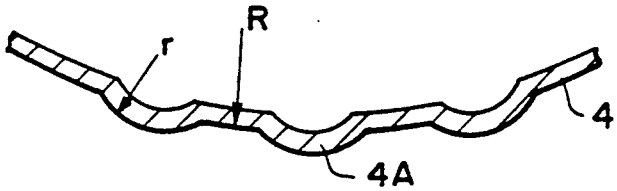
Figure 8C:
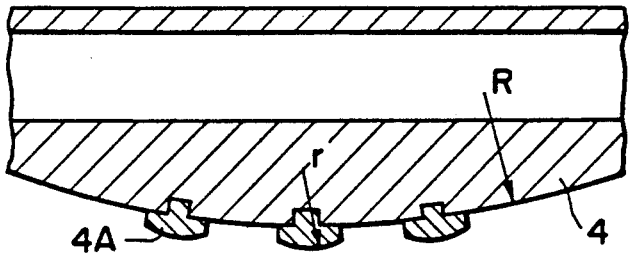
Figure 8D:
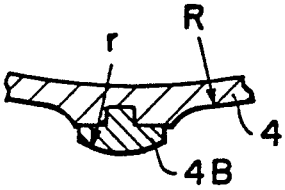
Figure 8E:
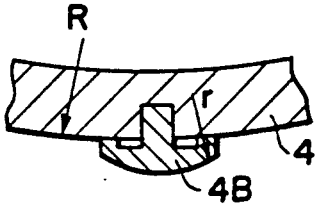

After the image has been transferred onto the transfer paper, the transfer paper is stably separated from the surface of the photoreceptor belt 1, the running direction of which is sharply changed around the circumferential surface of the above-mentioned roller 2. Then, the transferred image is fixed by the fixing roller 18' and the paper is delivered onto the delivery tray 20 through the delivery roller 19'. It is preferable that the transfer paper is electrically discharged by the discharging bar 12A provided next to the discharger 12 as illustrated in FIG. 6 or FIG. 7.

After the image has been transferred onto the paper, the photoreceptor belt continues to run and the residual toner on the belt is removed at the cleaning unit 13 in which the cleaning blade 13A and the toner conveyance roller 13B come into contact with the belt surface with pressure. After the residual toner has been removed from the belt surface, the blade 13A and the toner conveyance roller 13B are retracted from the belt surface so that a new image forming process can be started.

FIG. 3 illustrates the positional relation between the image forming units and the photoreceptor belt 1. FIG. 3-A is a sectional view of the charging means taken on line A—A of FIG. 1. FIG. 3-B is a sectional view of the developing unit taken on line B-B of FIG. 1. FIG. 3-C is a sectional view of a different image exposing means the laser diode exposing means, which is an optical system with a lens fibre array.

In FIG. 3-A, the numeral 6A is a back plate of the charger 6 and the numerals 6B are the electrode blocks which are provided to both sides of the back plate 6A. The letter $W_1$ is an electrode wire stretched between the above-mentioned electrode blocks 6B. The letter $W_2$ is a grid.

The protrusions 6C with a prescribed height are integrally provided to the electrode blocks 6B, wherein the protrusions have the function of spacing members. The charger is pushed by a spring member such as a leaf spring 6D so that the protrusions 6C can come into contact with the guide member 4 at the outside the photoreceptor belt edge 1.

Accordingly, the electrode wire $W_1$ and the grid $W_2$ can be located so that the gap between the wire and the surface of the photoreceptor belt or the gap between the grid and surface of the photoreceptor belt can be kept constant. As a result, the charger 6 can stably charge the photoreceptor to a predetermined electrical potential.

In FIG. 3-B, the numeral 9A is a developing sleeve of the developing unit 9. The numerals 9B are spacing rollers, wherein the spacing rollers 9B are rotatably provided to the shaft 9C of the developing sleeve 9A.

The external diameter of the spacing rollers 9B is a little larger than that of the developing sleeve 9A so that a gap corresponding to the developing gap can be formed between the circumferential surface of the developing sleeve 9A and the outer surface of the photoreceptor belt 1.

Accordingly, the surface of the developing sleeve 9A and the outer surface of the photoreceptor belt 1 form a constant developing gap (0.3 to 1 mm) which is adequate for non-contact development. Consequently, the developing unit 9 can always be operated to conduct proper development. The situation is the same in the case of the developing units 8, 10, and 11. Each built-in spacing roller is pressed to the guide member 4 with pressure by the publicly known spring means.

The structure and function of each developing unit will be described as follows, wherein the developing unit 9 is taken as an example.

Figure 4:
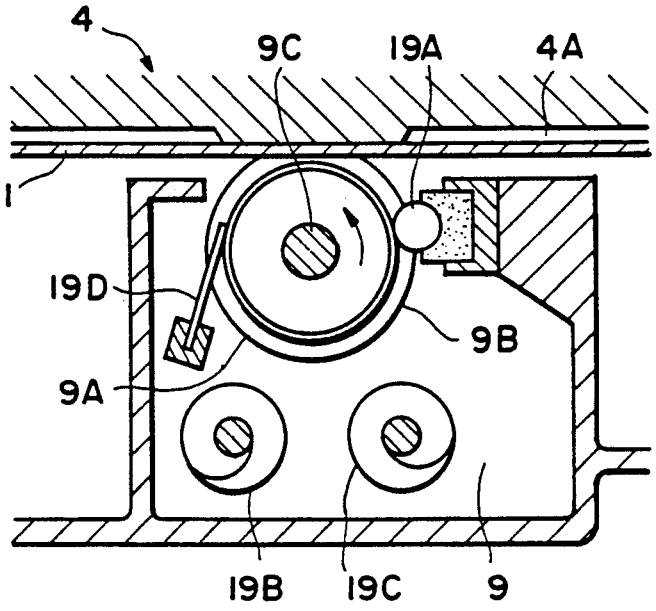
FIG. 4 is a sectional view of the developing unit.

FIG. 4 is a sectional view of the developing unit 9. The numeral 9A is a developing sleeve in which a magnetic roller is provided. A predetermined gap is kept between the surface of the developing sleeve 9A and the outer surface of the photoreceptor belt 1 by the spacing rollers 9B, wherein the spacing rollers 9B and the developing sleeve 9A are provided to the same shaft and the top surface of the developing sleeve 9A is rotated in the same direction as the photoreceptor belt 1. Either a stationary type magnetic roller or the rotary type magnetic roller can be used in the developing unit. The numeral 19A is a thin developer layer forming member which has stiffness and magnetism and which comes into contact with the developing sleeve 9A with a predetermined pressure when there is no developing agent around the circumferential surface of the developing sleeve 9A. The numerals 19B and 19C are a pair of conveyance screws which are rotated in the opposite direction to each other in order to convey and circulate the developing agent. The functions of the conveyance screws 19B and 19C are to stir the toner and carrier sufficiently and to convey the mixed toner and carrier (developer) to the developing sleeve 9A.

The above-described developer conveyance screws 19B and 19C are rotated in the opposite direction to each other and they function as both the conveyance member and the stirring member. The toner and carrier which were conveyed to the back side from the viewer by the conveyance screw 19B, are transferred to the conveyance screw 19C and conveyed to the viewer's side by the conveyance screw 19C. While the toner and the carrier are conveyed, they are mixed and made into a uniform developing agent which is charged by triboelectric charging. A layer of the developing agent adheres to the circumferential surface of the developing sleeve 9A.

A thin layer of the developing agent which adheres to the circumferential surface of the developing sleeve 9A, develops the latent image on the photoreceptor belt 1 which is run clockwise in the developing region, wherein the above-described developing gap is kept and the non-contact development is conducted.

In addition to the bias potential of D.C. component, A.C. biased D.C. is impressed on the developing sleeve 9A from a power source not illustrated in the drawing. As a result, only the toner is selectively jumped up from the developing sleeve 9A surface to the latent image surface on the photoreceptor belt and it adheres to the photoreceptor surface.

The carrier ratio in the developing agent becomes high because the toner component in the developing agent has been consumed. The developing agent is conveyed by the developing sleeve 9A and scraped off by the scraper 19D to be collected. After that, the developing agent is mixed with the developing agent which has a high toner ratio.

The numeral 17 shown in FIG. 3-C is an image exposing means which is composed of the optical system integrally comprising the fibre lens array 17A and the light emitting unit 17B such as a LED. The light emitting 17B and the protrusions 17C are integrally formed, wherein the protrusions 17C are located on both sides of the casing and have the predetermined height which is needed as a spacing member.

The optical system 17 is pushed by the spring means such as a leaf spring in the same way as the charger 6 so that the protrusions 17C can come into contact with the guide member 4 with pressure on the outside the photoreceptor belt 1 edge.

Accordingly, the distance between the optical system 17 and the photoreceptor belt 1 can be always kept constant so that the image can be precisely formed on the surface of the photoreceptor belt.

As the image forming means do not come into contact with the photoreceptor belt 1, the vibration caused when the photoreceptor belt 1 is driven does not affect the image forming means.

Since the photoreceptor belt 1 does not come into contact with the image forming means, the photoreceptor belt 1 is not worn. As the photoreceptor belt 1 does not come into contact with the image forming means, the frictional resistance is small and it is easy for the photoreceptor belt to be operated.

Furthermore, the apparatus of the present invention has the following advantage. The conveyance efficiency of the photoreceptor belt 1 may be decreased because of the frictional resistance caused by the rubbing motion between the photoreceptor belt 1 and the guide member 4 when the belt is operated. However, in the present invention, the frictional resistance can be remarkably reduced and the photoreceptor belt 1 can have a sufficient conveyance efficiency by avoiding the contact between the photoreceptor belt 1 and the guide member 4 in the region where the photoreceptor belt 1 does not face the charger 6, the optical system 17 and the developing sleeves of the developing units, wherein the cut-back portions 4A are formed on the surface of the guide member 4 in the region where the guide surface does not face the charger 6, the optical system 17 and the developing sleeves so that the contact between the photoreceptor belt surface and the guide member surface can be avoided.

Since the apparatus of the present invention has the structure explained above, the slippage and deformation of an image caused by the slip of the photoreceptor belt 1 can be prevented.

It is preferable that the cut-out portions are provided on the guide surface between the developing units as illustrated in FIG. 1. In the non-contact development which is adopted in the present invention, the effective area to the photoreceptor belt 1 is small. Accordingly, a wide cut-out portion can be provided to the guide member 4. The width of the guide member 4 in the region where the guide member faces the developing unit, can be 5 mm to 30 mm which is necessary for the purpose. When the width is too narrow, the necessary developing width can not be obtained and when the width is too wide, the frictional resistance of the photoreceptor belt 1 is increased and its conveyance efficiency is decreased. It is also effective that the cut-out portions are provided on the guide surface between the charger and the exposing position and between the exposing position and the developing unit.

As illustrated in FIGS. 3-A, 3-B, and 3-C, a pair of guide rails IA are provided on the inside surface of the photoreceptor belt 1, wherein the guide rails engage with the guide grooves 4B provided on the guide member 4.

Figure 5A:
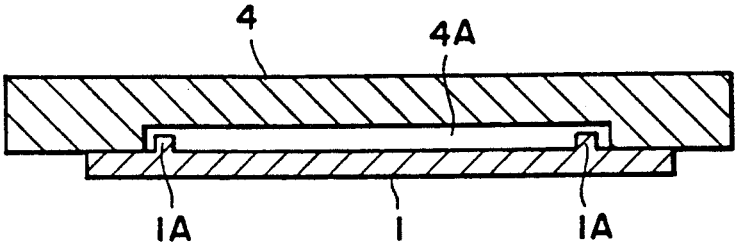
FIGS. 5-A and 5-B are sectional views of the cut-out portion of the guide member.
Figure 5B:
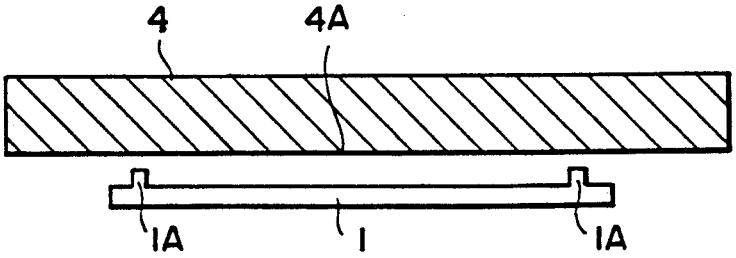

FIGS. 5-A and 5-B show the positional relation between the photoreceptor belt 1 and the cut-out portion 4A in the region where the photoreceptor belt 1 does not face the image forming means. These sectional views are taken from the same direction as FIGS. 3-A, 3-B and 3-C. FIG. 5-A illustrates the case in which the cut-out portion of the guide member is formed in the region which is inside the guide rails 1A. FIG. 5-B illustrates the case in which the cut-out portion of the guide member is formed in the region both inside and outside the guide rails 1A. As the apparatus has the structure described above, the conveyance efficiency of the photoreceptor belt can be increased and the snaking of the belt which tends to occur during the conveyance can be prevented.

According to the present invention, a color image forming apparatus with a flexible photoreceptor belt can be provided which is characterized in that: the photoreceptor belt can be run at a stable speed by reducing the frictional resistance; accordingly, a color image of high quality, well registrated and non deformed can be obtained; and the apparatus can be made compact.

An example of a color image forming apparatus will be explained in which the image forming means faces the photoreceptor belt with precise gap so that an excellent image can be obtained.

Referring to FIG. 7 which illustrates a color image forming apparatus, the guide member 4 is formed as follows. The guide member 4 which has the radius of curvature of R has protrusions having the convex surface 4A on it and the convex portions 4A contact with the rear surface of the photoreceptor belt 1. The rear surface of the photoreceptor belt 1 is slidably conveyed over on the surface of the convex portion 4A of the guide member 4 so that the photosensitive surface of the photoreceptor belt 1 can be set at a predetermined position and the belt can be constantly kept at the position when the belt is run.

As described above, the convex portion 4A is a smoothly formed convex surface with a radius of curvature r. Accordingly, when the photoreceptor belt 1 is slidably conveyed over the convex portions 4A, its frictional resistance is small and the photoreceptor belt 1 uniformly comes into contact with the convex portion 4A. Consequently, the photoreceptor belt 1 can be smoothly operated at a stable speed.

When the radius of curvature R of the guide member 4 is large, the convex portion seems to be nearly the same as a plane surface. Accordingly, each developing unit can be arranged in line in parallel with each other. In that case, each developing unit can have the same structure, which is quite advantageous so as to reduce the cost of the apparatus and to simplify the structure. Each developing unit may be arranged not only in parallel but also on the line of the radius of curvature R. In this case, when each developing unit is mounted on the apparatus, it is a little inclined. However, its inclination is very little. Consequently, the advantage of utilizing the developing unit of the same structure can be derived even in this case. However, when a large radius of curvature is adopted to the convex portion of the guide member, there is a problem that the contact pressure applied to the convex portion 4A by the photoreceptor belt 1 is small and the photoreceptor belt 1 may separate from the surface of the convex portion 4A. In order to solve the problem described above, as shown in FIG. 6, the radius of curvature Rs of at least one end of the guide member 4 can be made smaller than the radius of curvature R explained above so that the contact pressure applied to the convex portion 4A by the photoreceptor belt 1 can be increased.

When the apparatus is put into practical use, the effective radius of curvature R is 200 mm to 2000 mm and the effective radius of curvature Rs is 50 mm to 200 mm. When R and Rs are appropriately determined, the inequality $R > Rs$ must be satisfied so that the stability of conveyance of the photoreceptor belt 1 can be obtained.

When the radius of curvature R of the middle portion of the guide member 4 is set large and the radius of curvature Rs of the both side portion of the guide member 4 are set small, the photoreceptor belt including the guide member can be made compact compared with the photoreceptor belt including the guide member which has the same radius of curvature R, wherein the middle portion of the guide member and the both side portion of the guide member have a common radius of curvature R. When the radius of curvature of the both side portion of the guide member is different from that of the middle portion of the guide member, the positions of the charger 6 and the cleaning unit 13 are moved upward.

The guide member 4 can be used as a container into which the collected waste toner is put. In this case, a hollow guide member is applied to the apparatus, wherein the guide member has the structure of an airtight vessel. When the end portion of the guide member 4 has a smaller radius of curvature Rs than the middle portion of the guide member 4, the cleaning unit and the waste toner collecting vessel can be closely located so that the waste toner can be easily collected, which is advantageous.

Referring to FIG. 7, an example of a color image forming apparatus will be explained.

In this example, the radius of curvature R of the guide member 4 on which the photoreceptor belt 1 is slidably conveyed, is relatively large. Furthermore, the portions of the guide member 4 which face the image forming means are made of a plurality of the protrude with convex surfaces 4A which have a smaller radius of curvature r than the above-described radius of curvature R.

The above-mentioned convex portions 4A are provided to 6 positions: they are the portions of the guide member which face the developing sleeves 8A, 9A, 10A, 11A, the charger 6, and the exposing unit of the optical unit 7. A surface which is a little withdrawn from the convex surface, is provided between the convex surfaces 4A.

Accordingly, the photoreceptor belt 1 comes into contact with the top of each convex surface 4A. As a result, the contact pressure between the photoreceptor belt and the guide member can be kept constant and the photoreceptor belt 1 can stably come into contact with the guide member 4.

Consequently, the photosensitive surface of the photoreceptor belt 1 which faces each image forming means can be always set to a predetermined position and the photoreceptor belt 1 can be smoothly operated at a predetermined speed because the frictional resistance is reduced.

According to the experiment conducted by the inventors, it is preferable that the radius r of curvature of the above-described convex portion 4A is at least 10 mm to 100 mm and the radius R of curvature of the conveyance surface of the guide member 4 is 200mm to 2000mm. When the radius r of curvature is not more than 10 mm, the surface of the photoreceptor belt 1 is not sufficiently flat in order to form an image. For that reason, the width of the photoreceptor belt necessary for the image forming means can not be obtained in the developing region and the charging region. On the other hand, when the radius r of curvature is not less than 100 mm, the photoreceptor belt surface is sufficiently flat. However, the tension of the photoreceptor belt is not enough and the belt tends to separate from the guide member surface. Concerning the radius R of curvature, when R is not more than 200 mm, the photoreceptor belt is not sufficiently flat and it becomes difficult to arrange the image forming means to be in parallel with one another. When R is not less than 2000 mm, the tension of the photoreceptor belt is not large enough and the belt tends to separate from the guide member surface.

It is preferable that the guide member 4 and the convex portions 4A are integrally made by the method of molding or extrusion. It is possible to form the convex portions 4A on a flat plate by the plate pressing technique and to curve the plate so that the curved plate can have the radius R of curvature.

In FIG. 8, the sectional views of the guide member 4 which has a convex portion are illustrated. FIG. 8-*a* shows the guide member 4 and the convex portions 4A, wherein they are integrally formed by the method of molding or extrusion. FIG. 8-*b* shows the guide member 4 with the radius R of curvature and the convex portions 4A with the radius r of curvature, wherein they are formed by the plate pressing technique. FIG. 8-*c* shows the guide member 4 with the radius R of curvature to which the convex portions 4A with the radius r of curvature are provided FIG. 8-*d* and 8-*e* are sectional views of the main portion of the guide member in which the convex portions 4B and 4B' are made from material different from the guide member 4 itself, wherein the guide member 4 may be made either of metal sheet by the plate pressing technique or of plastics by the method of molding. The convex portions 4B and 4B' may be made from either metal by the method of drawing or plastics by the method of molding. The convex portions 4B and 4B' are engaged with the guide member 4, wherein an adhesive agent is applied to fix them to the guide member 4.

As explained in the above-described example, a compact color image forming apparatus can be provided which is characterized in that: a flexible photoreceptor belt for use in an image forming apparatus can be precisely set to a predetermined position so that the photoreceptor belt can be operated at a stable speed; and accordingly, the efficiency of each image forming means can be completely exhibited and a high quality color image can be always obtained.

What is claimed is:

1. A color image forming apparatus, comprising:
a photoreceptor endless belt;
a unitary guide plate having a guide surface for guiding said endless belt, said guide surface including;
a plurality of contact portions which contact said endless belt; and
at least one non-contact portion which does not contact said endless belt;
a plurality of developing means each positioned to respectively face a different one of said plurality of contact portions; and
said endless belt being mounted on said guide plate to pass between said guide surface and each of said plurality of developing means.

2. A color image forming apparatus according to claim 1, wherein said guide surface is generally saucer shaped.

3. A color image forming apparatus according to claim 2, wherein said guide surface has a flat portion forming a base of said saucer shape and two curved portions respectively forming sides of said saucer shape.

4. A color image forming apparatus according to claim 1, wherein said at least one non-contact portion of said guide surface is formed by at least one recess formed in said guide surface to reduce friction between said endless belt and said guide plate.

5. A color image forming apparatus according to claim 1, further comprising:
two rotatable rollers;
said guide plate being positioned between said two rotatable rollers;
said photoreceptor endless belt being stretched around said rotatable rollers so as to pass between said guide surface and said plurality of developing means and slidably contacting said plurality of contact portions of said guide surface.

6. A color image forming apparatus according to claim 1, further comprising:
two rotatable rollers;
said guide plate being positioned between said rotatable rollers;
image forming means, including said plurality of developing means, positioned to face said guide surface;
said photoreceptor belt being stretched around said two rotatable rollers so as to pass between said guide surface and said image forming means; and
spacing means for positioning said image forming means to face said guide pate with a predetermined space therebetween.

7. A color image forming apparatus according to claim 6, wherein:
said endless belt has first and second flat surfaces;
said apparatus further comprises:
support members for said photoreceptor endless belt mounted to support said first and second flat surfaces of said endless belt; and
said spacing means includes a movable contacting member for contacting said support members to position said image forming means.

8. A color image forming apparatus according to claim 7, further comprising:
cleaning means for cleaning said endless belt;
wherein said image forming means includes;
charging means and said image exposure means; and
wherein said photoreceptor endless belt is stretched around said rotatable rollers so as to pass between said guide surface and said plurality of image forming means and said cleaning means.

9. A color image forming apparatus according to claim 8, wherein said photoreceptor endless belt has first and second flat surfaces, said apparatus further comprising:
support members for said endless belt positioned to support said first and second flat surfaces of said endless belt; and
a movable contacting member for contacting said support members to position said plurality of image forming means.

10. A color image forming apparatus according to claim 9, wherein said photoreceptor endless belt and said cleaning means are formed as one unit which is detachable from said color image forming apparatus.

11. A color image forming apparatus according to claim 8, wherein said photoreceptor endless belt and said cleaning means are formed as one unit which is detachable from said color image forming apparatus.

12. A color image forming apparatus according to claim 1, further comprising recesses formed in said plurality of developing means in areas spaced from said contact portions of said guide surface to reduce friction when said endless belt moves.

13. A color image forming apparatus comprising:
a photoreceptor belt;
a plurality of developing means;
a unitary guide means having a guide surface thereof which faces said plurality of developing means;
said endless belt being mounted on said guide means to pass between said guide surface and said plurality of developing means;
friction reducing means provided between said guide surface of said guide means and said plurality of developing means for reducing friction as said endless belt moves over said guide surface; and
said surface having a plurality of defined contact areas thereon, said plurality of developing means being respectively positioned to face at least a portion of different ones of said contact areas.

14. An image forming apparatus according to claim 13, wherein said friction reducing means comprises at least one recess formed in said guide surface of said guide means, said plurality of developing means being positioned to oppose said surface in areas other than where said at least one recess is formed.

15. The image forming apparatus according to claim 13, wherein said friction reducing means comprises recesses formed in at least a portion of each of said plurality of developing means.

* * * * *

UNITED STATES PATENT AND TRADEMARK OFFICE

CERTIFICATE OF CORRECTION

PATENT NO. : 5,063,411

DATED : November 5, 1991

INVENTOR(S) : HANEDA et al

It is certified that error appears in the above-identified patent and that said Letters Patent is hereby corrected as shown below:

Title page, Section [56] References Cited, under "FOREIGN PATENT DOCUMENTS", change the Japanese reference "63133743" to read -- 63-133743 --.

Signed and Sealed this

Twentieth Day of April, 1993

*Attest:*

MICHAEL K. KIRK

*Attesting Officer*

*Acting Commissioner of Patents and Trademarks*